United States Patent [19]

Chiang et al.

[11] Patent Number: 4,776,281

[45] Date of Patent: Oct. 11, 1988

[54] COMBUSTIBLE PUSH ROD FOR LAUNCHING TUBULAR PROJECTILES

[75] Inventors: Tien-Hon Chiang, El Toro; Donald N. Thatcher, Santa Ana, both of Calif.

[73] Assignee: Aerojet-General Corporation, La Jolla, Calif.

[21] Appl. No.: 21,280

[22] Filed: Mar. 3, 1987

[51] Int. Cl.[4] ..... F42B 11/00; F42B 13/00; F42B 7/08

[52] U.S. Cl. ..... 102/532; 102/503

[58] Field of Search ..... 102/503, 532, 431, 442

[56] References Cited

U.S. PATENT DOCUMENTS 4,301,736 11/1981 Flatau et al. ..... 102/503

4,318,344 3/1982 Price et al. ..... 102/520

*Primary Examiner*—Charles T. Jordan

*Attorney, Agent, or Firm*—Leonard Tachner

[57] ABSTRACT

A push rod for use in launching tubular projectiles employs a pyrophoric sintered mesh cloth machined to mate with the aft end of the tubular projectile within the gun barrel. The mesh cloth is configured to be entirely consumed during the initial portion of the external ballistic cycle and to push the projectile during the internal ballistic cycle. A preselected thickness of cellulose impregnated paper sheet, adhesively bonded to the aft end of the mesh cloth, delays combustion of the push rod until after the projectile and push rod have left the gun barrel.

13 Claims, 1 Drawing Sheet

COMBUSTIBLE PUSH ROD FOR LAUNCHING TUBULAR PROJECTILES

BACKGROUND OF THE INVENTION

1. Field of the Invention

This invention relates generally to ammunition and firearms and more specifically, to an improved combustible push rod used for launching tubular projectiles, the push rod being designed to sustain the gun barrel pressure and permit a high muzzle velocity for the projectile and yet be consumed by total combustion after the projectile leaves the gun barrel whereby to avoid potential foreign object damage to the platform of the gun such as an aircraft.

2. Prior Art

Tubular projectiles provide certain advantages over their non-tubular counterparts. Such advantages include a flatter trajectory, longer range, shorter flight time and superior penetration of the target. These advantages are derived principally from a significant reduction in the mass of the projectile as compared to non-tubular projectiles. Such reduction in mass along with certain aerodynamic design characteristics produces considerably less drag during the external ballistic cycle of the projectile. By way of example, one such advantageous tubular projectile is disclosed in U.S. Pat. No. 4,301,736 to Flatau et al issued Nov. 24, 1981. However, unlike non-tubular projectiles, the hollow configuration of tubular projectiles makes them inherently problematical in regard to applying high acceleration forces to the aft end of the projectile and in regard to maintaining the launching pressures within the gun tube which might otherwise be significantly reduced by the inadvertent passage of the gases produced by the burning propellants in the gun tube through the hollow center of the projectile. Solutions to this problem include some means for sealing the aft end of the projectile at least while it is in the gun tube and preferably until it attains the desired muzzle velocity. Such sealing means include pusher disks or pusher rods and sabots or some combination of these elements. By way of example, the aforementioned U.S. Pat. No. 4,301,736 discloses the use of a pusher disk which transmits the high acceleration forces from the propellant gases within the gun tube to the projectile and also discloses the use of a sabot which is designed to maintain the high pressure condition within the gun tube during the internal ballistic cycle. During the internal ballistic cycle tubular projectiles need a base or other certain device to seal one end of the hollow tube to sustain the gun barrel pressure and attain a high muzzle velocity. However, during the external ballistic cycle, the base has to separate from the projectile or be self-consumed in order to provide the projectile with a low aerodynamic drag to permit the benefit of the advantages of a tubular projectile.

When the tubular projectile is fired from an aircraft, a self-consumed base has to be used in order to avoid potential foreign object damage to the aircraft. One proposed solution to this problem is disclosed in U.S. Pat. No. 4,318,344 issued Mar. 9, 1982 to Price et al. This patent discloses a combustible sabot for use on spinning tubular projectiles. The disclosure maintains that prior combustible-type sabots were either too weak to maintain the pressure in the weapon barrel or burn too slowly at the pressure in the breech of the propellant powder or are too difficult or impossible to fabricate. The patent disclosure purportedly provides an invention which overcomes these prior art problems by providing a sabot which uses an epoxy anhydride binder compatible with and filled with energetic solid particles consisting of ammonium perchlorate, magnesium or aluminum, amorphous boron and molybdenum trioxide. Unfortunately, the combined installation and fabrication process relating to the integration of the sabot and the projectile is extremely complex and time consuming and therefore expensive. Furthermore, there is some question as to whether or not the epoxy base described in the Price et al patent is sufficiently strong to withstand the pressure exerted on it by the expanding weapon gases.

There is therefore a need for a self-consuming push rod for a tubular projectile which is structurally more capable of withstanding the internal ballistic process and which is relatively simple to fabricate as compared to the prior art. In addition, it is necessary to provide such a device which avoids gun barrel erosion otherwise caused by at least partial combustion of the push rod or sabot before the projectile has fully exited the gun barrel.

SUMMARY OF THE INVENTION

The present invention solves the aforementioned need by providing a combustible push rod made from a sintered mesh cloth infiltrated with a propellant and/or oxidant for launching tubular projectiles. The sintered mesh cloth which may be reinforced with metallic fiber or perforated plate is made of pyrophoric metallic materials such as titanium, aluminum, zirconium, and the like or their alloys. The mesh cloth provides a high surface area-to-volume ratio which can burn very rapidly when ignited particularly because it is infiltrated with either propellant or oxidant or a combination of the two. In addition, the sintered mesh cloth provides sufficient mechanical strength to clearly withstand the gun barrel pressure during the internal ballistic cycle for launching the projectile. In addition, the sintered mesh cloth invention herein disclosed is provided with a unique concave shape on the forward end permitting the push rod to act as a spring so that a compressive force is exerted from the push rod onto the projectile during deformation of the push rod. This force is exerted as a result of the set back force during the internal ballistic cycle.

To avoid gun barrel erosion, a combustible nitrocellulose impregnated Kraft paper sheet is adhesively bonded to the aft end of the push rod. This combustible sheet is provided with a thickness designed so that the sintered mesh cloth infiltrated with the propellant and/or oxidant will not actually be ignited until the projectile and the push rod leave the muzzle of the gun barrel to aid the ignition of the sintered mesh cloth. The combustible paper sheet is bonded to the aft end of the mesh cloth with special bonding adhesive containing ignition chemicals such as potassium perchlorate.

The sintered mesh cloth is machine fabricated and vacuum-infiltrated with castable propellant/oxidant using a selectively shaped mandrel and then the cellulose impregnated Kraft paper sheet is adhesively bonded to the aft end of the propellant/oxidant infiltrated sintered mesh cloth. The resultant unique push rod assembly is of superior geometry and physical and chemical structure to satisfy the objectives of the prior art in a far stronger and more easily fabricated configuration which more readily permits exploitation of the inherent advantages of a spinning tubular projectile.

OBJECTS OF THE INVENTION

It is therefore a principal object of the present invention to provide a combustible push rod assembly for launching tubular projectiles and which is stronger and more readily manufactured as compared to comparable prior art.

It is an additional object of the present invention to provide a combustible push rod assembly made from sintered mesh cloth infiltrated with propellant and/or oxidant for use in launching tubular projectiles.

It is still an additional object of the present invention to provide a combustible push rod assembly which utilizes a combustible nitrocellulose impregnated paper sheet to delay the combustion of a sintered mesh cloth until after the projectile and push rod have exited the gun barrel thereby avoiding gun barrel erosion.

It is still an additional object of the present invention to provide a combustible push rod assembly utilizing sintered mesh cloth infiltrated with propellant and/or oxidant for launching tubular projectiles and which is provided with a unique geometric shape designed to provide a compressive force against a projectile during the internal ballistic cycle.

BRIEF DESCRIPTION OF THE DRAWINGS

The aforementioned objects and advantages of the present invention as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
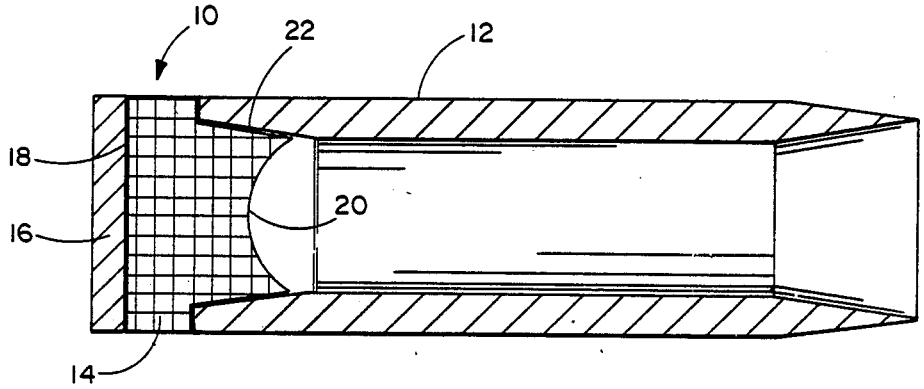
FIG. 1 is a cross-sectional view of a push rod assembly of the present invention shown installed in the aft end of a tubular projectile.

The basic design configuration of the combustible push rod assembly 10 of the present invention is shown in FIG. 1 where it is assembled to a tubular projectile 12 for launching. The principal component of the push rod assembly 10 is a sintered mesh cloth 14 which may be reinforced with metallic fiber or perforated plate and is made principally of pyrophoric metallic materials such as titanium, aluminum, zirconium, iron and the like or their alloys. The high surface area to volume ratio of the sintered mesh cloth 14 permits very rapid burning when ignited, particularly when it is infiltrated with propellant and/or oxidant in the manner to be described hereinafter. The sintered mesh cloth 14 provides the mechanical strength to withstand the gun barrel pressure during the internal ballistic cycle of launching the projectile.

The propellant infiltrated into the push rod may be a castable propellant that is cured at 90 degrees F after casting. Suitable propellants can be selected from a family of propellants described as Very High Burning Rate (VHBR) propellants which burn at a rate of 100 to 2,000 inches per second at 50,000 psi. Such propellants include HMX, TAGN, $B_{10}H_{10}^{-2}$ burn rate modifier, GAP binder and BTTN plasticizer. This allows burn out in less than 6 milliseconds and can actually convert the up-bore projectile (push rod and tubular projectile) into a traveling charge system.

The combustion of the pyrophoric sintered mesh cloth 14 including the infiltrated propellant and oxidant is expected to generate abrasive metal oxide and/or nitride particles. To avoid erosion of the gun barrel, a combustible nitrocellulose impregnated Kraft paper sheet 16 is adhesively bonded to the aft end of the push rod mesh 14. The thickness of the combustible paper sheet 16 is calculated so that the sintered mesh cloth 14 including its propellant and oxidant will not be ignited until the projectile 12 and the push rod assembly 10 leave the muzzle. The paper sheet 16 will be almost completely burned off at this point. To aid the ignition of the sintered mesh cloth, the bonding adhesive 18 between the combustible paper 16 and the sintered mesh cloth 14 may preferably contain ignition chemicals such as potassium perchlorate.

It is anticipated that during the internal ballistic cycle the setback force will be sufficiently high so that the push rod assembly 10 will be deformed and therefore there will be relative motion between the push rod mesh 14 and the tubular projectile 12. Therefore, the forward end of the push rod assembly 20, that is the region between the boat tail tapered sides 22, is of a concave shape which is designed to act as a spring so that compressive force can be exerted from the push rod assembly when it is deformed, onto the tubular projectile to thereby increase the frictional force between the push rod and the projectile.

The push rod assembly 10 may be fabricated in the following manner. First the mesh cloth is chosen based upon its type of weave, mesh, density, open area and of course, material. The preferred mesh cloth mesh density is from 16×16 to 200×200 meshes per linear inch. The open area is preferably in the range of 50 plus or minus 20%. The type of weave selected should give the highest strength and rigidness after sintering. The material selected should of course be pyrophoric, heat treatable and easily diffusion bonded such as Ti-6Al-4V alloy. Desirable layers of the mesh cloth are preferably stacked up with random orientation from layer-to-layer and then press diffusion bonded under inert atmosphere. If the Ti-6Al-4V alloy mesh cloth is utilized, the microstructure of the alloy shall be equiaxial $\alpha$ phase and diffusion bonded at a temperature lower than the $\beta$ transus.

Figure 2:
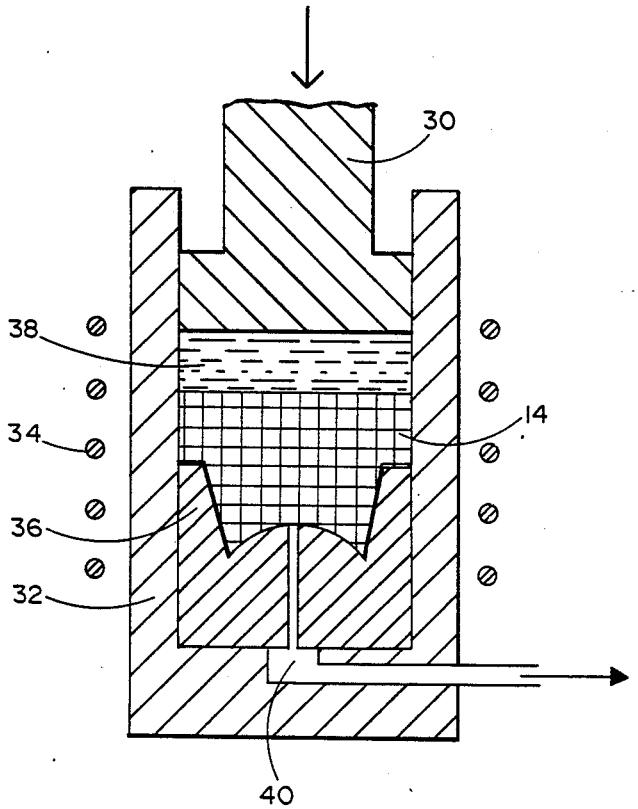
FIG. 2 is a schematic illustration of a step in the fabrication process of the present invention.

The diffusion bonded mesh cloth is then solution heat treated and aged to attain high strength and ductility. The multilayer sintered mesh cloth is then machined to the configuration shown in FIG. 1. The concave forward end 20 is preferably cold formed instead of being machined to provide the highest residual stress for spring back. The machine fabricated sintered mesh cloth is then ready for vacuum infiltration of castable propellant/oxidant in the manner shown in FIG. 2. As shown in FIG. 2, the infiltration process can utilize a mechanical press 30 having an evacuated container 32 surrounded by a heating element 34. The sintered mesh cloth 14 is positioned on a suitably shaped mandrel 36 through which there is a gas evacuation channel 40 leading to a vacuum pump not shown on the figure. The mechanical press 30 is designed to force castable propellant/oxidant resin 38 into the sintered mesh cloth 14. The propellant/oxidant is formulated such that the burning of the sintered mesh cloth is very rapid and complete during the external ballistics of the projectile. In the final step of the fabrication process the cellulose impregnated Kraft paper sheet 16 is adhesively bonded to the aft end of the propellant/oxidant infiltrated sintered mesh cloth 14 by suitable bonding adhesives 18.

It will now be understood that what has been disclosed herein comprises a combustible push rod assembly made from a sintered mesh cloth infiltrated with propellant/oxidant for launching tubular projectiles. The push rod sintered metal mesh cloth is provided with a concave face and a cone-shaped forward base portion and utilizes a Kraft paper covering on the aft end to delay combustion until the projectile and push rod assembly have exited the gun tube. The sintered metal mesh cloth base is significantly stronger than the epoxy base of the most relevant prior art and the sintering and infiltration fabrication process of the present invention are significantly simpler than repeated vacuum cycles for producing voids in an epoxy material as disclosed in the closest prior art. The sintered mesh cloth is preferably made of a pyrophoric metallic material such as titanium, aluminum, zirconium, iron or their alloys. The mesh cloth is specially prepared to have a high surface area to volume ratio which burns very rapidly when ignited, especially when infiltrated with propellant and/or oxidant in the manner described above. The sintered mesh cloth infiltrated with propellant/oxidant provides the mechanical strength to withstand the gun barrel pressure during the internal ballistic cycle of launching the projectile. The forward end of the push rod assembly is provided with a concave shape to provide a spring action during deformation which occurs during combustion. The aft end of the mesh cloth is bonded to a combustible paper sheet of selected thickness to delay the combustion of the push rod until after the push rod and projectile have left the gun barrel thereby avoiding gun barrel erosion that might otherwise occur as a result of the generation of abrasive metal oxide particles.

Those having skill in the art to which the present invention pertains will, as a result of the teaching herein, now perceive various modifications and additions which may be made to the invention. Thus for example, the concept of using a sintered metal mesh cloth may be advantageously employed for the same effect in other geometric shapes and using other materials. Furthermore, the mesh cloth may be replaced by other forms of materials having the same surface area to volume ratio such as randomly continuous metallic fiber or flake mat, perforated sheet or perforated plate. However, it will be understood that as long as such other shape geometries and material forms are compatible with the aft end geometry of the tubular projectile and as long as the material permits rapid total combustion of the mesh cloth or equivalent material, such modifications and additions are deemed to be within the scope of the present invention which is to be limited only by the claims appended hereto.

We claim:

1. A combustible push rod for use in launching a tubular projectile from a gun barrel; the push rod comprising:

a sintered mesh cloth made of a pyrophoric material configured to mate with the aft end of said tubular projectile within said gun barrel.

2. The push rod recited in claim 1 wherein said mesh cloth has a mesh density in the range of 16×16 to 200×200 meshes per linear inch.

3. The push rod recited in claim 1 wherein said mesh cloth is infiltrated with a propellant and oxidant.

4. The push rod recited in claim 1 wherein said mesh cloth is made of Ti-6Al-4V alloy.

5. The push rod recited in claim 1 wherein said mesh cloth has a concave forward end.

6. The push rod recited in claim 1 further comprising a cellulose impregnated paper sheet adhesively bonded to the aft end of said mesh cloth.

7. The push rod recited in claim 1 wherein said pyrophoric sintered material is taken from the group consisting of titanium, aluminum, zirconium, iron and alloys of titanium, aluminum, zirconium and iron.

8. The push rod recited in claim 6 further comprising an ignition chemical such as potassium perchlorate between said paper sheet and said mesh cloth.

9. The push rod recited in claim 1 wherein said mesh cloth comprises a plurality of randomly oriented layers diffusion bonded to one another.

10. The push rod recited in claim 3 wherein said propellant and oxidant are infiltrated into said mesh cloth in an evacuated press.

11. The push rod recited in claim 3 wherein said propellant is a castable VHBR propellant capable of burning at a rate of 100 to 2,000 inches per second at 50,000 psi.

12. A combustible push rod for use in launching a tubular projectile from a gun barrel; the push rod comprising:

a metallic fiber mat made of a pyrophoric material, heat treated, diffusion bonded and configured to mate with the aft end of said tubular projectile, said mat being sufficiently porous to have an open area of at least 30% for infiltration by a propellant impregnate.

13. A combustible push rod for use in launching a tubular projectile from a gun barrel; the push rod comprising:

a plurality of stacked, perforated sheets of pyrophoric material, heat treated, diffusion bonded and configured to mate with the aft end of said tubular projectile, said sheet having an open area of at least 30% for infiltration by a propellant impregnate.

* * * * *